US006227959B1

(12) United States Patent
Beaudry

(10) Patent No.: US 6,227,959 B1
(45) Date of Patent: May 8, 2001

(54) SANDING SPONGE

(76) Inventor: Donald W. Beaudry, P.O. Box 728, Elk River, MN (US) 55330

( * ) Notice: Subject to any disclaimer, the term of this patent is extended or adjusted under 35 U.S.C. 154(b) by 0 days.

(21) Appl. No.: 09/159,229

(22) Filed: Sep. 23, 1998

Related U.S. Application Data

(63) Continuation-in-part of application No. 09/028,918, filed on Feb. 24, 1998, now abandoned.
(60) Provisional application No. 60/049,769, filed on Jun. 6, 1997.

(51) Int. Cl.[7] ..... B24D 11/00
(52) U.S. Cl. ..... 451/526; 451/524; 451/490
(58) Field of Search ..... 451/354, 523, 451/524, 525, 507, 490, 522

(56) References Cited

U.S. PATENT DOCUMENTS

| | | | | |
|---|---|---|---|---|
| 2,523,884 | | 9/1950 | Swenson | 7/105 |
| 2,817,931 | | 12/1957 | Houser | 451/522 |
| 3,279,130 | | 10/1966 | Nelson | 451/522 |
| 3,998,012 | | 12/1976 | Ness | 451/523 |
| 4,182,000 | * | 1/1980 | Fairbairn | 15/236 B |
| 4,202,139 | | 5/1980 | Hong et al. | 451/524 |
| 4,774,789 | | 10/1988 | Amalfi | 451/344 |
| 4,802,310 | * | 2/1989 | Holmes | 451/357 |
| 4,825,597 | | 5/1989 | Matechuk | 451/524 |
| 4,829,719 | * | 5/1989 | Braselton | 451/354 |
| 4,885,876 | | 12/1989 | Henke | 451/503 |
| 4,892,343 | * | 1/1990 | Hall | 294/64.1 |
| 5,016,402 | * | 5/1991 | Reiter | 451/354 |
| 5,036,627 | * | 8/1991 | Walters | 451/354 |
| 5,054,248 | | 10/1991 | Thayer | 451/524 |
| 5,123,139 | * | 6/1992 | Leppert et al. | 15/230.17 |
| 5,131,193 | | 7/1992 | Demers | 451/524 |
| 5,245,797 | * | 9/1993 | Milkie | 451/354 |
| 5,309,681 | * | 5/1994 | Cheney et al. | 451/344 |
| 5,479,675 | * | 1/1996 | Pytlewski | 15/235.4 |
| 5,605,500 | * | 2/1997 | Matechuk | 451/456 |
| 5,624,305 | * | 4/1997 | Brown | 451/354 |
| 5,944,294 | * | 8/1999 | Baer | 248/220.43 |

FOREIGN PATENT DOCUMENTS

| | | |
|---|---|---|
| 345435 | 5/1960 | (CH) . |
| 315287 | 10/1989 | (EP) . |
| 2065512 | 7/1981 | (GB) . |
| 2244945 | 12/1991 | (GB) . |

* cited by examiner

*Primary Examiner*—W. Donald Bray
(74) *Attorney, Agent, or Firm*—Richard C. Litman

(57) ABSTRACT

A sanding sponge primarily used for sanding finished dry wall. In its least complicated embodiment, the tool is a hand-held sanding sponge made from a cellular foam material into a block having a top portion with a nonabrasive surface to ensure a comfortable grip and a bottom portion with an abrasive surface and acutely angled opposed edges, to allow the sponge to be used for sanding the corners and angles of finished drywall. In alternate embodiments the sanding sponge has means for attachment to a commercially available pole sander, or the sanding sponge may form an annular disk having a removable abrasive layer on one side and a hole formed through its radial center adapted for attachment: to an electric power sander.

3 Claims, 7 Drawing Sheets

SANDING SPONGE

CROSS-REFERENCE TO RELATED APPLICATIONS

This is a continuation-in-part of a prior application Ser. No. 09/028,918, filed Feb. 24, 1998, and now abandoned claiming the benefit of U.S. provisional patent application Ser. No. 60/049,769, filed Jun. 16, 1997.

BACKGROUND OF THE INVENTION

1. Field of the Invention

The present invention relates to tools for sanding a surface and, more specifically, to a sanding sponge constructed of a cellular foam material.

2. Description of Related Art

Abrasive sanding tools are used in a wide variety of applications which require smoothing, cleaning, feathering, or otherwise finishing a surface. Some applications, such as sanding corners and angles of finished dry wall, require hand sanding where a user will grasp a coated abrasive sheet in their hand and apply it directly to the surface being treated. This process is often ineffective because irregular pressure, such as caused by fingers against the back side of the abrasive sheet in use, produces an irregular abraded surface, or because the surface to be treated is difficult or impossible to reach directly by hand.

In order to overcome this inefficiency, several tools which assist in the holding of an abrasive surface have been disclosed in the related art. These have included hand-held foam blocks having abrasive surfaces permanently or removably attached thereto and handle attached rigid blocks having an abrasive surface fixedly or removably attached thereto.

U.S. Pat. No. 5,054,248, issued Oct. 8, 1991 to Donald R. Thayer, discloses a hand-held sanding sponge molded from a flexible cellular foam into a block having an easily gripped handle on its top surface and an abrasive layer removably attached to its bottom surface. One edge of the bottom surface is acutely angled while the opposed edge is curved to allow the sanding sponge to be used on a variety of surfaces including corners and curved surfaces.

U.S. Pat. No. 5,131,193, issued Jul. 21, 1992 to Michael J. Demers, discloses a hand-held sanding tool adapted for abrading a surface having a specific contour. The tool has an upper portion forming an easily gripped handle and a lower portion having an abrasive surface with a predetermined profiled contour matching the configuration of a groove wall on an automobile part.

U.S. Pat. No. 3,998,012, issued Dec. 21, 1976 to Reuben Ness, discloses a sanding sponge in the form of a cellular plastic cylinder having a layer of abrasive material removably secured to its bottom end with an adhesive substance. The bottom end of the sanding sponge may have a variety of curved or angled contours and the top end of the sponge may have a layer of fibrous material adhered thereto to act as a cushion for the users hand and to be used to remove dust from the surface being treated.

U.S. Pat. No. 4,202,139, issued May 13, 1980 to In S. Hong and Glen E. Roelofs, discloses a hand-held sanding tool comprising a pad having a bottom surface adapted to have an adhesive coated abrasive sheet attached thereto and a top surface having a handle adapted to be wrapped around one or more of a users fingers to hold the pad in place on the users hand. The sanding tool of Hong et al. is intended to minimize the user's discomfort while sanding.

U.S. Pat. No. 4,825,597, issued May 2, 1989 to William Matechuk, discloses a handle mounted sanding tool adapted for sanding corner joints in dry wall construction. The tool has a resilient foam block which has two abrasive faces adapted to fit the contour of a corner and which is mounted on a pole-attached carrier that properly distributes the force exerted on the handle to the faces of the foam block.

U.S. Pat. Nos. 2,817,931, issued Dec. 31, 1957 to Burdette C. Houser, and 3,279,130, issued Oct. 18, 1966 to Arthur E. Nelson, also disclose handle mounted sanding tools adapted for sanding corner joints. Both tools have carriers with two faces joined at an angle that are adapted to have sandpaper wrapped therearound and secured in place.

U.S. Pat. No. 4,774,789, issued Oct. 4, 1988 to Jerome L. Amalfi, discloses a hand-held sanding tool adapted for sanding an external corner. The sanding tool of Amalfi has two opposed plates with abrasive surfaces joined at a right angle which are reciprocated by a motor in the small handle extending rearwardly from the opposed plates.

U.S. Pat. No. 4,885,876, issued Dec. 12, 1989 to David R. Henke, discloses a sanding tool for sanding a flat surface which has a hand grip which is interchangeable with a pole grip. The tool is adapted to have sandpaper wrapped around a base member and secured in place by attaching one of the grips to the top of the base member.

U.S. Pat. No. 2,523,884 issued Sep. 26, 1950 to H. R. Swenson discloses a sander-scraper combination having a sander block having a rectangular shape. Swiss Patent 345,435 published May, 1960 discloses a sanding block mounted to a pole sander, the block being rectangular with radially shaped ends. United Kingdom Patent Number 2,065,512 issued Jul. 1, 1981, discloses a hand tool with a handle and a blade, the blade being essentially a sanding block having sand paper wrapped around both faces and retained by clips, but no pad, the blade having a variety of shapes including rectangular and wedge shapes.

European Patent Number 315,287 published Oct. 5, 1989 discloses a hand sander including a plate or block having four symmetrically arranged holes, the sand paper extending through the holes and being clamped by tongues. United Kingdom Patent Number 2,244,945 issued Dec. 18, 1991 discloses a hand held sanding block having a flexible band of sand paper fitting snugly around the circumference of the block.

None of the prior art, however, discloses a sanding sponge made of a flexible foam material which has a nonabrasive surface, adapted alternatively to be held by the user's fingertips or to be placed on the end of a pole sander, with two acutely angled edges on opposed sides of its primary abrasive surface.

None of the above inventions and patents, taken either singly or in combination, is seen to describe the instant invention as claimed.

SUMMARY OF THE INVENTION

The present invention is a sanding sponge primarily intended to be used for sanding angles and corners of finished dry wall. In its least complicated embodiment, the tool is a hand-held sanding sponge made from a cellular foam material into a block having a top portion with a nonabrasive surface to ensure a comfortable grip and a bottom portion with an abrasive surface to treat the surface to be sanded. The top portion of the sanding sponge forms a generally rectangular parallelepiped and the bottom portion of the sanding sponge forms a right prism whose bases are isosceles trapezoids so that the opposed lateral faces and the bottom surface of the sanding sponge are joined at an acute angle. This configuration is ideal for sanding the corners and angles of finished drywall.

In alternate embodiments the sanding sponge is adapted to be removably attached to a separate sanding tool such as a commercially available pole sander or an electric power sander. When adapted to be attached to a pole sander, the top portion of the sanding sponge is removed. In one embodiment, a dove tail groove adapted to receive the end of a pole sander is formed in the top surface of the bottom portion of the sanding sponge. In another embodiment, a hook and loop type fastening material, such as "Velcro", is adhesively bonded to the top surface of the bottom portion of the sanding sponge, and a hook type fastening material is attached to the end of the pole sander.

When adapted to be attached to a power sander, the sanding sponge forms a pad to which a sanding disk having a layer of abrasive material may be removably attached either adhesively or by hook and loop fastening material, whereby one sponge may be used as a pad for a plurality of sanding disks.

Accordingly, it is a principal object of the invention to provide a sanding tool having acutely angled opposed edges on its bottom surface to maximize its efficiency when used for sanding corners and angles of dry wall.

It is another object of the invention to provide a sanding sponge having a nonabrasive grip portion to prevent cuts and friction burns on the users fingers.

It is a further object of the invention to provide a sanding sponge adapted to be attached to a commercially available pole sander.

Still another object of the invention is to provide a sanding sponge having a removable abrasive layer and being adapted to be attached to an electric sander.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
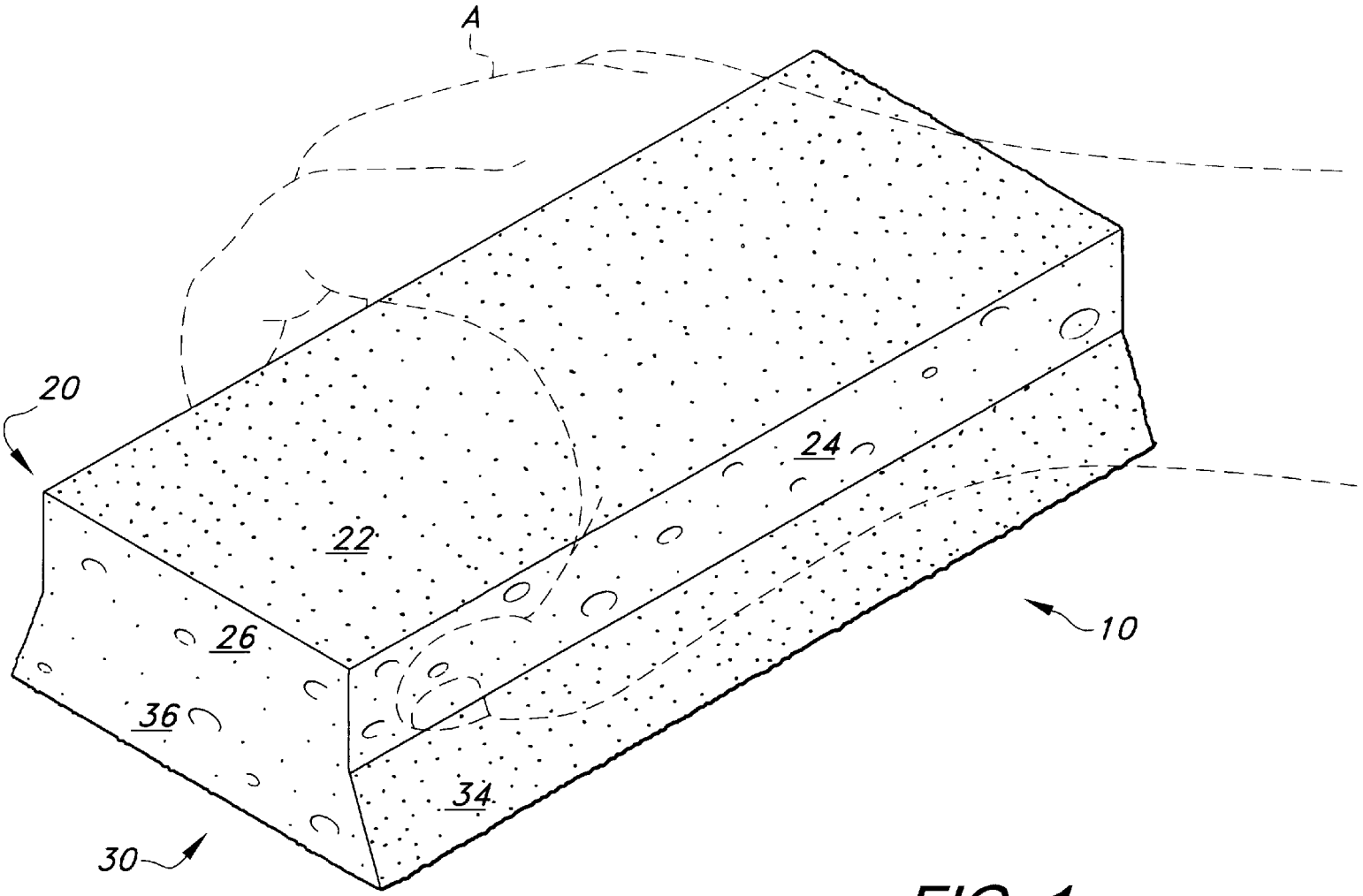
FIG. 1 is an environmental perspective view of the sanding sponge of the present invention.

Referring to the drawings, FIG. 1 illustrates the sanding sponge 10 of the present invention intended to be used for sanding angles and corners of finished dry wall. In its first embodiment, the sanding sponge 10 is formed from a cellular foam material into a top portion 20 adapted to be grasped by a user's hand A and a bottom portion 30 having an abrasive layer 40 for sanding corners and angles on installed dry wall.

The bottom portion 30 of the sanding sponge 10 is formed by a rectangular bottom surface 32 having two laterally spaced end surfaces 36 extending upwardly from the opposed short sides of the bottom surface 32 and two laterally spaced side surfaces 34 extending upwardly and inwardly from the opposed long sides of the bottom surface 32. When viewed from an end, as in FIG. 2, the bottom portion 30 of the sanding sponge 10 resembles an isosceles trapezoid.

Figure 2:
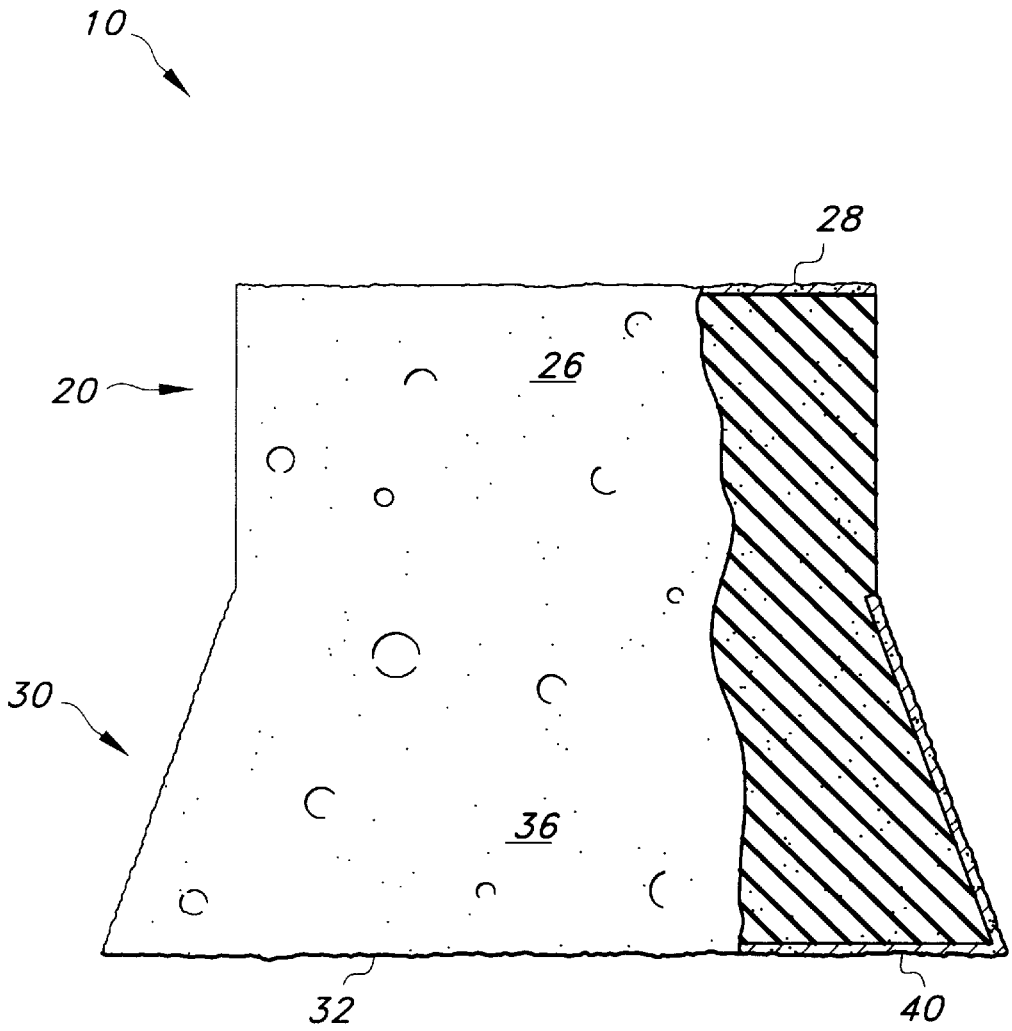
FIG. 2 is a partially sectioned, side view of the of the sanding sponge of the present invention.

Also illustrated in FIG. 2 is the abrasive layer 40 fixedly attached to or formed integrally on the bottom surface 32 and side surfaces 34 of the bottom portion 30 of the sanding sponge. In alternate embodiments, the side surfaces 34 may remain free of the abrasive layer 40, but it has been found that the abrasive layer 40 will wear less rapidly under normal use conditions when adhered to the side surfaces 34 as well as the bottom surface 32 of the bottom portion 30 as a continuous layer of material.

While the side surfaces 34 may join the bottom surface 32 of the bottom portion 32 at any acute angle, it has been found in practice that joining the side surfaces 34 and the bottom surface 32 at an angle of approximately 45° gives the bottom portion 30 of the sanding sponge 10 properties ideal for sanding angles and corners of dry wall.

In the first embodiment of the present invention, the top portion 20 of the sanding sponge 10 is formed integrally with the bottom portion 30 of the sanding sponge and is defined by a rectangular top surface 22 having two laterally spaced and parallel end surfaces 26 and two laterally spaced and parallel gripping surfaces 24. The end surfaces 26 of the top portion 20 extend downwardly from the opposed short sides of the top surface 22 to the end surfaces 36 of the bottom portion 30. The two gripping surfaces 24 extend downwardly from the opposed long sides of the top surface 22 to the side surfaces 32 of the bottom portion 30.

The top surface 22 of the top portion preferably has an abrasive layer 28 adhered thereto which may have different properties from the abrasive layer 40 on the bottom portion 30 of the sanding sponge, while the gripping surfaces 24 are formed by the exposed cellular foam, as shown in FIG. 2. This allows the sanding sponge 10 to be grasped along the gripping surfaces 24 by a users fingertips, thereby guarding them and eliminating scratching or causing friction burns on the users fingertips.

Figure 4:
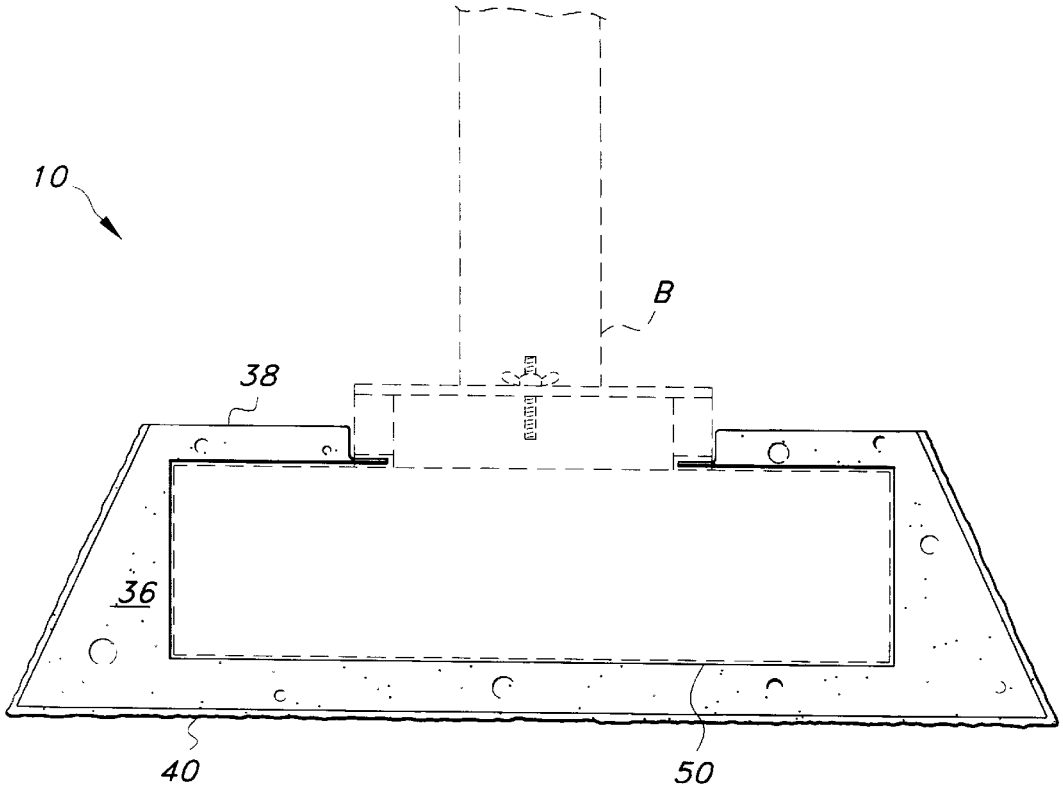
FIG. 4 is an environmental side view of a second embodiment of the sanding sponge of the present invention.

In the second embodiment of the present invention, the sanding sponge 10 is adapted to be placed on the end of a common commercially available sanding pole B, as is illustrated in FIG. 4. In order to allow the sanding sponge 10 to be attached to the end of the sanding pole B, the top portion 20 of the sanding sponge 10 is not included, and a dovetail groove 50 is formed in the top surface 38 of the bottom portion 30.

Figure 3:
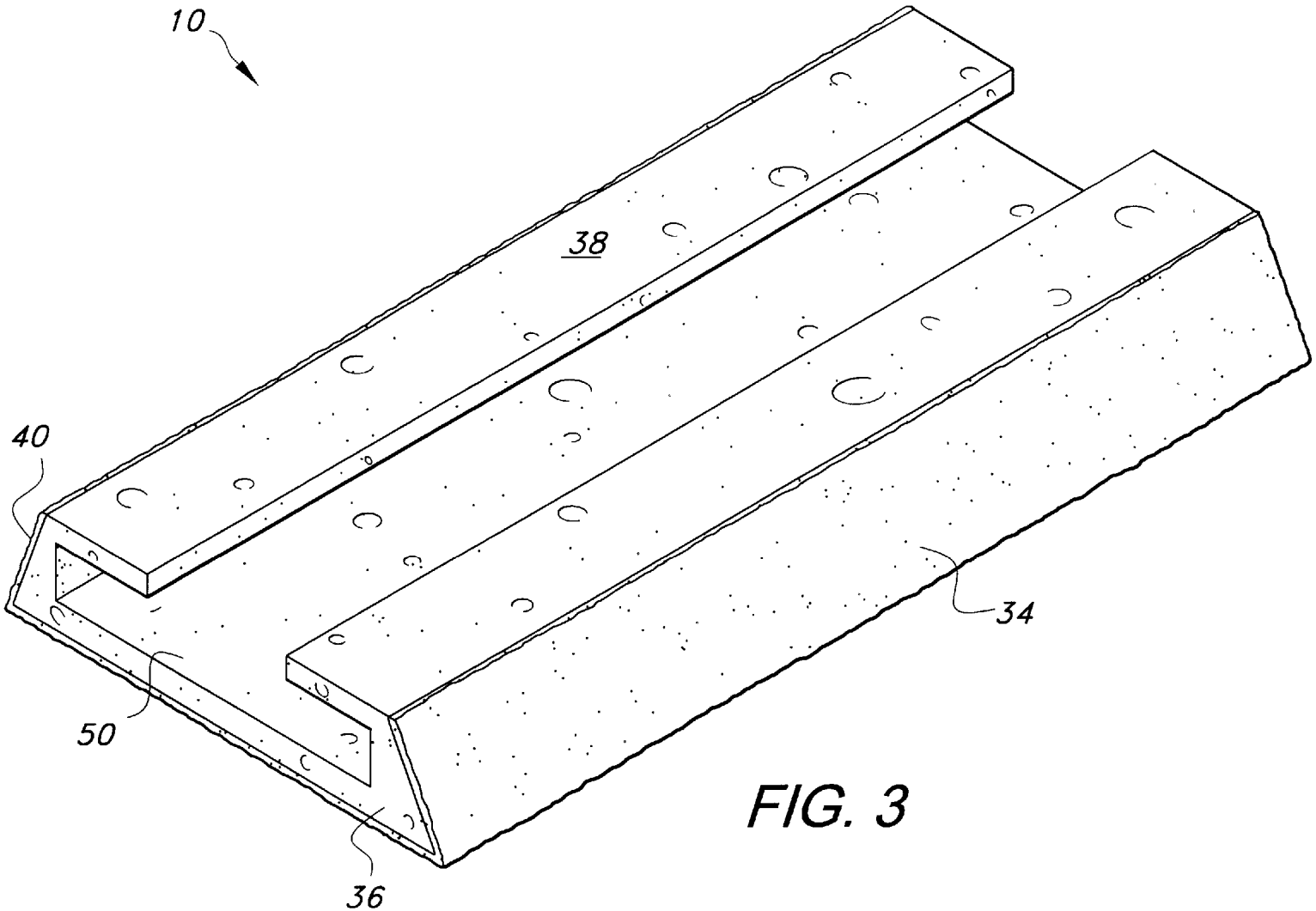
FIG. 3 is a perspective view of a second embodiment of the sanding sponge of the present invention.

The dovetail groove 50 runs longitudinally through the bottom portion 30 of the sanding sponge between the two ends 36 thereof. This can be seen in FIG. 3. When viewed from an end, the dovetail groove 50 resembles an inverted T having predetermined dimensions slightly larger than the cross section of the end of the sanding pole B. This allows the sanding sponge to be slid over the end of the sanding pole B and clamped in place thereon as shown in FIG. 4.

Figure 6:
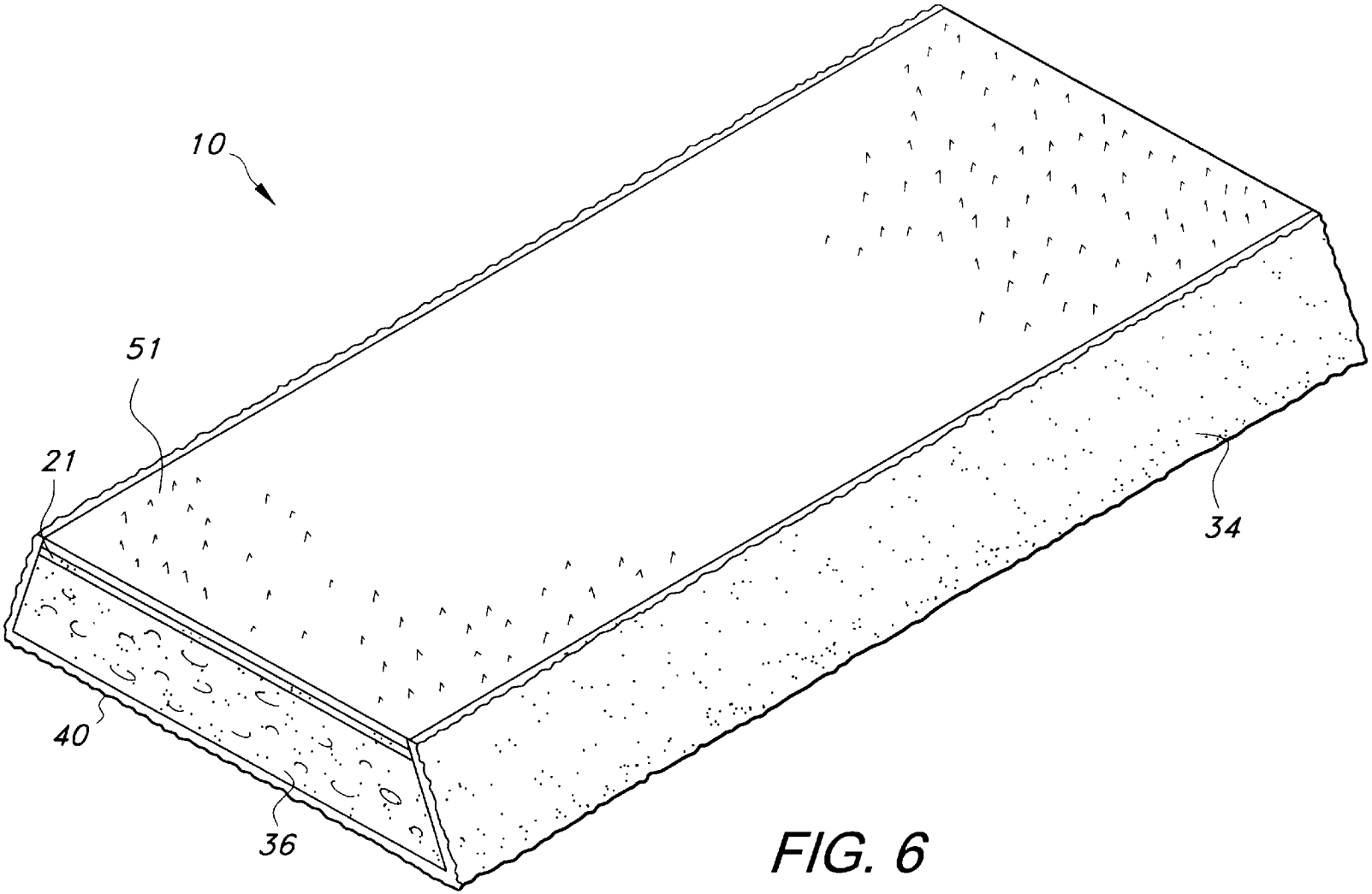
FIG. 6 is a perspective view of a fourth embodiment of the sanding sponge of the present invention.

Alternatively, as shown in FIG. 6, the top portion 20 of the sander sponge 10 is not included, and a strip of hook and loop type fastening material 51, such as that sold under the trade designation "Velcro", is adhesively bonded to the top surface 38 of the bottom portion 30 of the sander sponge by a suitable adhesive 21. A corresponding and mating strip of the fastening material (not shown) packaged with the sander sponge and adapted to fit on any standard size pole sander is attached to the end of the pole sander.

In the third embodiment of the present invention, the sanding sponge 10 is adapted to be attached to a commercially available power sander. In this embodiment, the sanding sponge 10 is formed from a body of cellular foam material into a disk 58 defined by a circular rear surface 60, a circular forward surface 62 having the same dimensions as, and being spaced substantially parallel to, the rear surface 60, and an outer sidewall 64. The disk 58 has a hole 66 having a predetermined radius formed through its radial center from the rear surface 60 to its forward surface 62, defining an inner sidewall 65, which allows the disk 58 to be removably attached to the head of a power sander C.

Removably attached to the forward surface 62 of the disk-shaped body 58 around the hole 66 formed therethrough is a substantially flat sanding disk 70 having a circular abrasive layer on one surface and a layer of adhesive attached to its opposite surface which allows it to be removably attached to the forward surface 62 of the disk-shaped body 58. The sanding disk 70 has a hole 72 with a radius greater than the radius of the hole 66 through the disk-shaped body 58 formed through its radial center to facilitate attachment to the power sander C. This is illustrated in FIG. 5.

In its third embodiment, the sanding sponge 10 may be packaged with a plurality of sanding disks 70 so that a new abrasive layer may be quickly and easily attached to the forward surface 62 of the disk-shaped body 58 when the old one becomes worn. This saves the user the time and expense of replacing the entire cellular foam disk-shaped body 58 whenever the abrasive layer 70 becomes worn as is common in the prior art.

Figure 5:
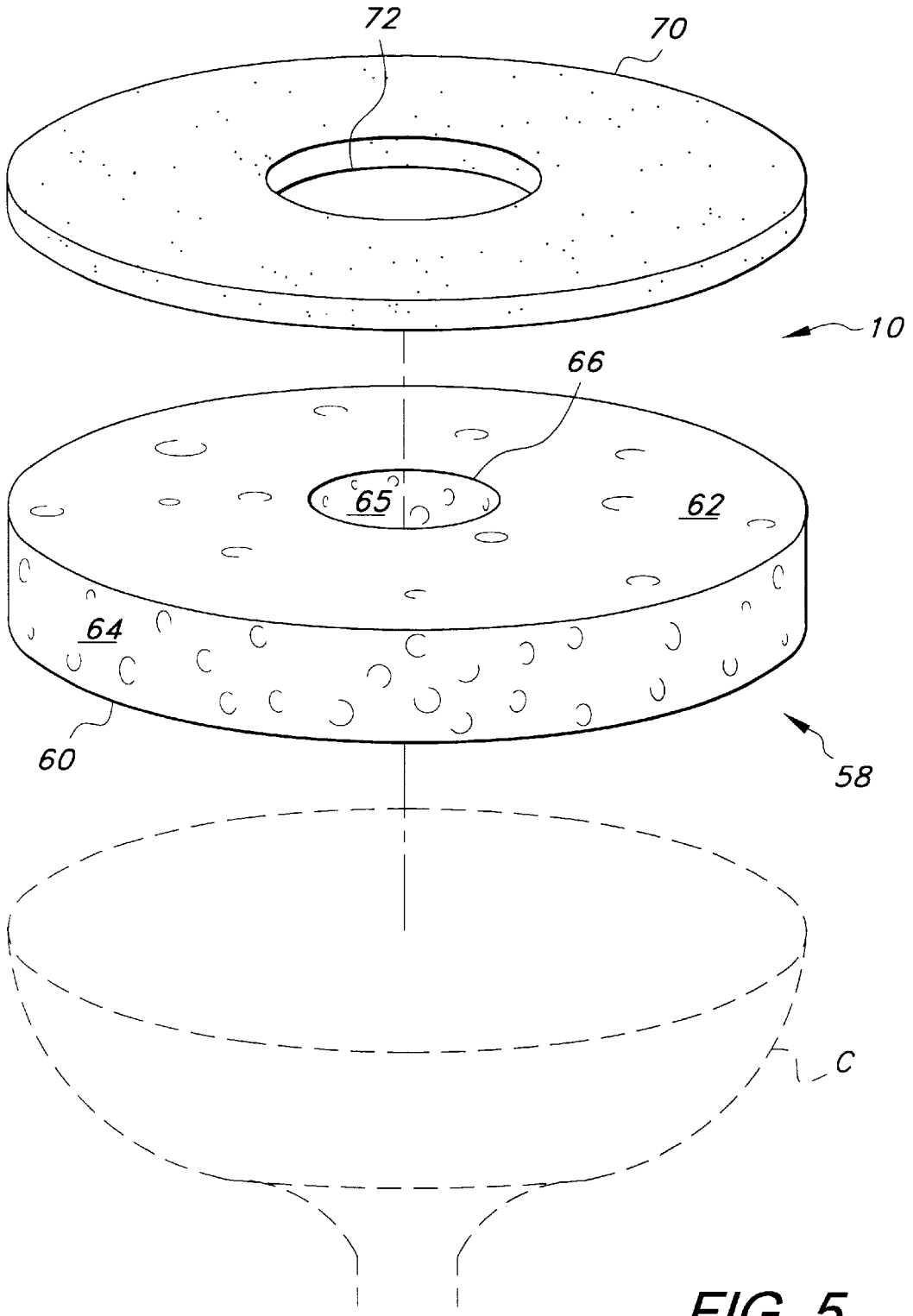
FIG. 5 is an exploded perspective view of a third embodiment of the sanding sponge of the present invention.
Figure 7:
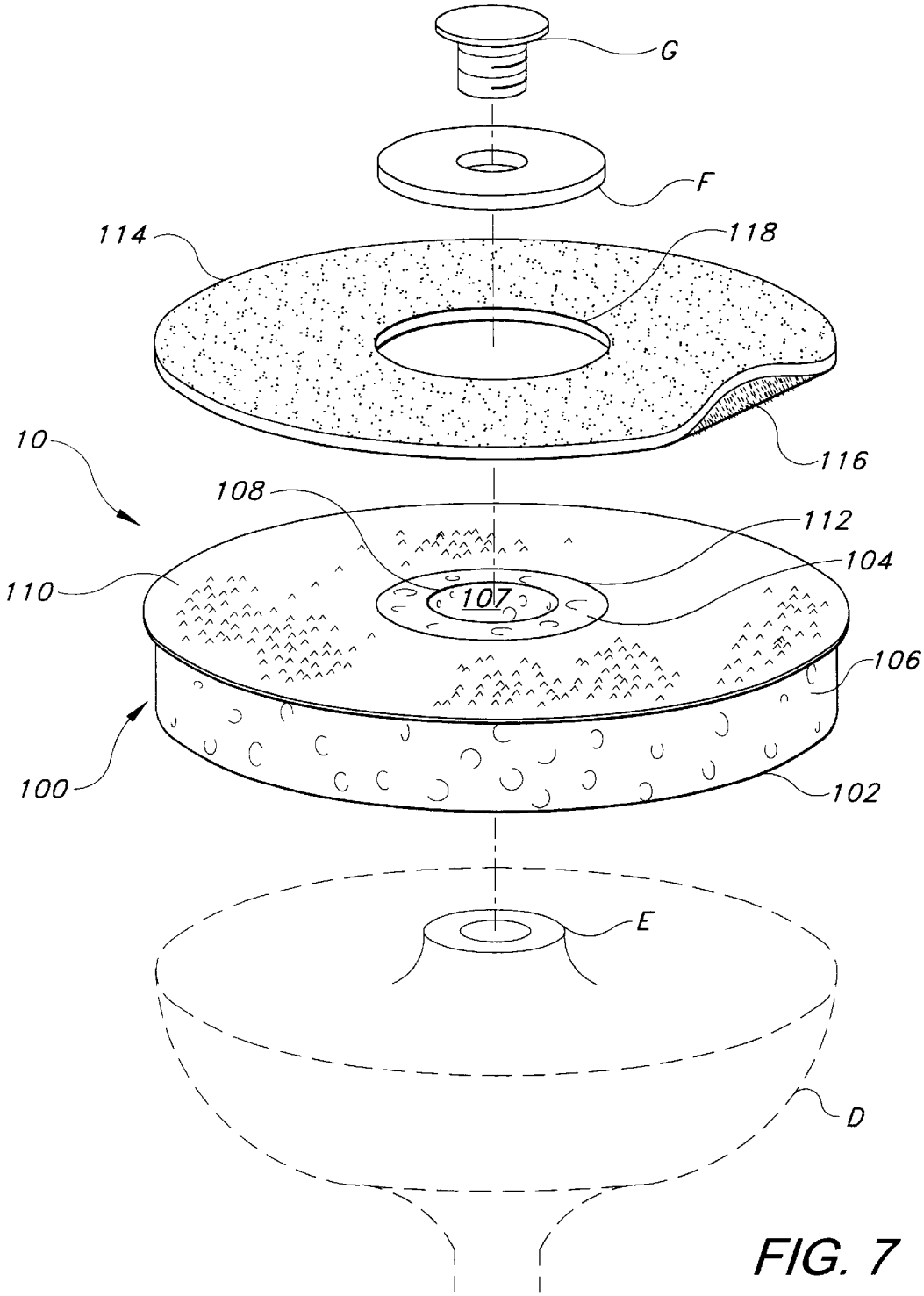
FIG. 7 is an exploded, environmental, perspective view of a fifth embodiment of the sanding sponge of the present invention showing the method of attachment to an electric drywall sander, shown with a portion of the sanding disc folded up to show both surfaces.

FIG. 7 shows an alternate embodiment of the sanding sponge 10 which is identical to the sanding sponge 10 shown in FIG. 5 except for the means of attaching the sanding disk to the sponge 10. The sanding sponge 10 shown in FIG. 7 is a cylindrical disk-shaped body 100 made from a resilient cellular foam material and adapted for attachment to a commercially available electrically powered drywall sander. The disk-shaped body 100 has a circular rear surface 102, a circular forward surface 104, and an outer sidewall 106. The disk-shaped body 100 has a hole 108 having a predetermined diameter defined through its center and extending from the front surface 104 through the disk-shaped body 100 to the rear surface 102, defining an inner sidewall 107, the diameter of the hole 108 being adapted for installing the disk-shaped body 100 on the rotating hub E of a drywall sander D.

A circular layer 110 of one component of a hook and loop fastening material, such as "Velcro", is permanently adhered to the front surface 104 of the disk-shaped body 100 of the sanding sponge 10. In the preferred embodiment the circular layer 110 of fastening material comprises a layer of J-hook material glued to the front surface 104 of the disk-shaped body 100. The circular layer 110 of fastening material has a hole 112 defined therein having a greater diameter than that of the hole 108 defined in the disk-shaped body 100. In a typical drywall sander D the abrasive disk is mounted on the rotating hub E of the sander by a large washer F and a retainer bolt G. The hole 112 defined in the layer 110 of fastening material has a diameter slightly larger than the diameter of the washer F. Consequently the disk-shaped body 100 is secured to the sander by tightening the retainer bolt G in order to compress the washer F and center of the resilient sanding sponge body 100 without also compressing the circular layer 110 of fastening material.

Removably attached to the front surface 104 of the disk 100 is a thin, substantially flat, sanding disk 114 having a circular abrasive layer on one side and a layer 116 of hook and loop fastening material permanently adhering to its opposite side. In the preferred embodiment the layer 116 of hook and loop fastening material comprises the loop portion of the "Velcro" hook and loop fastening material. The sanding disk 114 has a hole 118 defined therein having a diameter slightly largely than the diameter of the washer F and substantially equal to the diameter of the hole 112 defined in the center of the layer 110 of fastening material on the front surface 104 of the resilient body 100. In this manner the sanding disk 114 may be quickly and easily replaced as it becomes worn without the necessity for replacing the disk-shaped body 100 of the sanding sponge 10. A typical drywall sander D operates at about one thousand to two thousand revolutions per minute, and the "Velcro" hook and loop fastening material is more than adequate to adhere the sanding disk 114 to the disk-shaped sanding sponge body 100 at these speeds.

It is to be understood that the sanding sponge of the present invention is not limited to the embodiments described above, but encompasses any and all embodiments within the scope of the following claims.

I claim:

1. A sanding tool for use with a pole sander, comprising a one-piece body composed of a resilient flexible material, the body having the shape of a right prism wherein each of the bases is an isosceles trapezoid, said body including:

(a) a top surface having means adapted to receive the end of a commercially available sanding pole;

(b) a bottom surface;

(c) a first side face;

(d) a second side face; and (e) said bottom surface, said first side face, and said second side face being coated by a layer of abrasive material fixedly attached thereto.

2. The sanding tool according to claim 1 wherein said means adapted to receive the end of a commercially available sanding pole comprises a groove formed longitudinally through the top surface of said body, the top surface having a pair of flanges projecting into said groove and extending the length of the groove to define an elongated T-shaped slot adapted for receiving a head of a pole sander.

3. The sanding tool according to claim 1 wherein said means adapted to receive the end of a commercially available sanding pole comprises a component strip of a hook and loop fastening material permanently attached to said top surface, the component strip being adapted to temporarily engage a mating component strip of hook and loop fastening material attached to the end of a commercially available pole sander.

* * * * *

UNITED STATES PATENT AND TRADEMARK OFFICE

CERTIFICATE OF CORRECTION

PATENT NO. : 6,227,959 B1
DATED : May 8, 2001
INVENTOR(S) : Donald W. Beaudry, Leonard Launderville, Jr. et al.

It is certified that error appears in the above-identified patent and that said Letters Patent is hereby corrected as shown below:

Title page,
Item [76], should read: -- [76] Inventors: Donald W. Beaudry, P.O. Box 49485, Blaine, MN 55449-0485; Leonard Launderville, Jr., 16460 Tippecanoe Street NE, Ham Lake, MN 55304 --

Signed and Sealed this

Fifth Day of March, 2002

*Attest:*

*Attesting Officer*

JAMES E. ROGAN
*Director of the United States Patent and Trademark Office*